US005818189A

United States Patent [19]

Uchiyama et al.

[11] Patent Number: 5,818,189

[45] Date of Patent: Oct. 6, 1998

[54] ELECTRIC POWER-ASSISTED WHEELCHAIR

[75] Inventors: Atsushi Uchiyama; Hiroaki Ogata, both of Iwata, Japan

[73] Assignee: Yamaha Hatsudoki Kabushiki Kaisha, Iwata, Japan

[21] Appl. No.: 798,279

[22] Filed: Feb. 14, 1997

[30] Foreign Application Priority Data

Feb. 14, 1996 [JP] Japan ..... 8-027040

[51] Int. Cl.[6] ..... G02B 5/00

[52] U.S. Cl. ..... 318/488; 318/432; 318/139; 318/646; 180/907

[58] Field of Search ..... 318/432–434, 318/139, 646, 488; 180/6.5, 11, 65.2, 65.8, 907

[56] References Cited

U.S. PATENT DOCUMENTS

| | | | |
|---|---|---|---|
| 4,050,533 | 9/1977 | Seamone | 180/6.5 |
| 4,125,169 | 11/1978 | Harris et al. | 180/6.5 |
| 4,415,049 | 11/1983 | Wereb | 180/6.5 |
| 4,422,515 | 12/1983 | Loveless | 180/6.5 |
| 4,634,941 | 1/1987 | Klimo | 318/139 |
| 4,667,136 | 5/1987 | Bell | 318/51 |
| 4,767,940 | 8/1988 | Tuttle | 307/116 |
| 5,222,567 | 6/1993 | Broadhead et al. | 180/15 |
| 5,234,066 | 8/1993 | Ahsing et al. | 180/6.5 |
| 5,270,624 | 12/1993 | Lautzenhiser | 318/432 |
| 5,427,193 | 6/1995 | Avakian | 180/65.5 |
| 5,497,056 | 3/1996 | Kurland et al. | 318/269 |
| 5,648,708 | 7/1997 | Littlejohn | 318/488 |

FOREIGN PATENT DOCUMENTS 0687454 12/1995 European Pat. Off. .

OTHER PUBLICATIONS

European Search Report dated Nov. 26, 1997.

*Primary Examiner*—Brian Sircus
*Attorney, Agent, or Firm*—Knobbe, Martens, Olson & Bear LLP

[57] ABSTRACT

A power-assisted wheelchair wherein the power-assist for the wheels is based upon the manual force exerted on both of the wheels. The power-assist is continued for a brief time period after manual power input is stopped. The continuing assist is provided equally to each wheel so that the wheelchair will coast in a straight direction. The wheels of the wheelchair are readily detachable with the backing plate prime mover and transmission for driving the wheel.

12 Claims, 15 Drawing Sheets

ELECTRIC POWER-ASSISTED WHEELCHAIR

BACKGROUND OF THE INVENTION

This invention relates to an electric power-assisted wheelchair and more particularly to an improved control therefor.

There has been proposed a type of wheelchair that employs, in addition to the manual operator, a prime mover assist such as that provided by an electric motor. This is in contradistinction to the type of powered vehicle which is utilized by disabled persons in that the individual actually provides a portion of the motive power for the wheelchair. This has a number of advantages, both physical and mental.

In a very desirable type of wheelchair of this type, each of the wheels is provided with a hand rim to which the operator inputs a manual force. A torque sensor is associated with each hand rim and senses the magnitude of the manual force input by the operator. An electric motor is associated with each wheel and a control provides an electric power assist for that wheel in proportion to the amount of manual force input by the wheelchair occupant to the rim of the wheel. In this way, the electric motor assists, rather than overrides the manual input having the aforenoted types of advantages.

There is, however, a certain disadvantage to this type of mechanism which may arise under certain specific conditions. That is, the operator himself may have more strength in one arm than the other. When the operator is manually operating the wheelchair, he can compensate for this himself. However, the power assist may give rise to a situation where the operator may have to input more force than desirable in order to maintain the wheelchair traveling in a straight path or may have to make frequent corrections in the direction of travel because the power assist will amplify the inequality in the arm strength. That is, the power assist may tend to promote deviation of the wheelchair from the exact path desired by the user.

It is, therefore, a principal object of this invention to provide a power-assisted wheelchair wherein the amount of power assist can be tailored to suit the particular rider's physical characteristics.

It is a further object of this invention to provide a power assist for the wheels of a wheelchair wherein the assist for one wheel may be varied relative to the other wheel in order to maintain more uniform straight-ahead motion when desired.

Another riding condition that must be adapted for in the power-assist mechanism is the situation when the rider discontinues the application of manual force. It must be remembered that an important goal of the use of power assist for wheelchairs is to have the wheelchair perform substantially like one without any power assist. That is, the power assist should function primarily and substantially solely for augmenting the rider's power and not replacing it.

With normal non power-assisted wheelchairs, there are many times when the user permits the wheelchair to coast. However, when a power-assist mechanism is employed, the coasting characteristics of the wheelchair will be deteriorated. This is due to the added weight and the fact that the assist motor may constitute a drag when coasting.

There have been proposed, therefore, systems wherein the powered operation is maintained but on a diminishing scale once the rider ceases the application of manual power. This will provide a better simulation of the coasting of a non power-assisted wheelchair.

In addition, if the operator is on an incline and releases the hand wheels, then if power assist is immediately stopped, the wheelchair may begin to roll down the grade. This may be undesirable. This is another reason why it is desirable to maintain the power assist for at least a temporary time period when manual input force is discontinued.

During the coasting period when the power assist is being continued to simulate a more natural coasting mode, the unequal power assist which may have been caused by different inputs from one wheel to the other will tend to cause a continued operation in a curved, rather than a straight path. This may not be desirable.

It is, therefore, a still further object of this invention to provide an improved power-assisted wheelchair wherein the coasting operation is designed so as to be stabilized and in a primarily straight path.

In spite of all the foregoing comments regarding the desirability of maintaining, at least at some times, a straight path for the wheelchair, it is also known that the conventional wheelchairs are steered by the rider applying more force to one wheel than the other, by breaking one wheel or by rotating one wheel in a forward direction and the other wheel in a rearward direction. Thus, if the system operates so as to stabilize or maintain uniform power assists on each side of the vehicle, then turning may be deteriorated.

It is, therefore, a still further object of this invention to provide an improved power-assisted wheelchair wherein traveling in a straight line under power assist is facilitated but this is done in such a way that the turning or changing of direction of the wheelchair is not impeded.

SUMMARY OF THE INVENTION

This invention is adapted to be embodied in a power-assisted, manually operated wheelchair having a seat for a rider. A pair of ground-engaging wheels are disposed on opposite sides of the seat. Each of the wheels has a hand rim for operation by a rider seated in the seat to turn the wheels and manually propel the wheelchair. A primer mover is associated with each of the wheels for selectively assisting manual force applied thereto. A pair of force sensors are provided and each is associated with a respective one of the hand rims for measuring the force applied thereto. A control device controls the prime movers so that the power assist operation provided to each wheel by the prime mover is related to the force sensed by each of the force sensors.

BRIEF DESCRIPTION OF THE DRAWINGS

FIG. 12 is a block diagram showing the relationship between the wheels hand rims and control circuitry to illustrate how the total torque applied to each wheel is arrived at.

DETAILED DESCRIPTION OF THE PREFERRED EMBODIMENTS OF THE INVENTION

Figure 1:
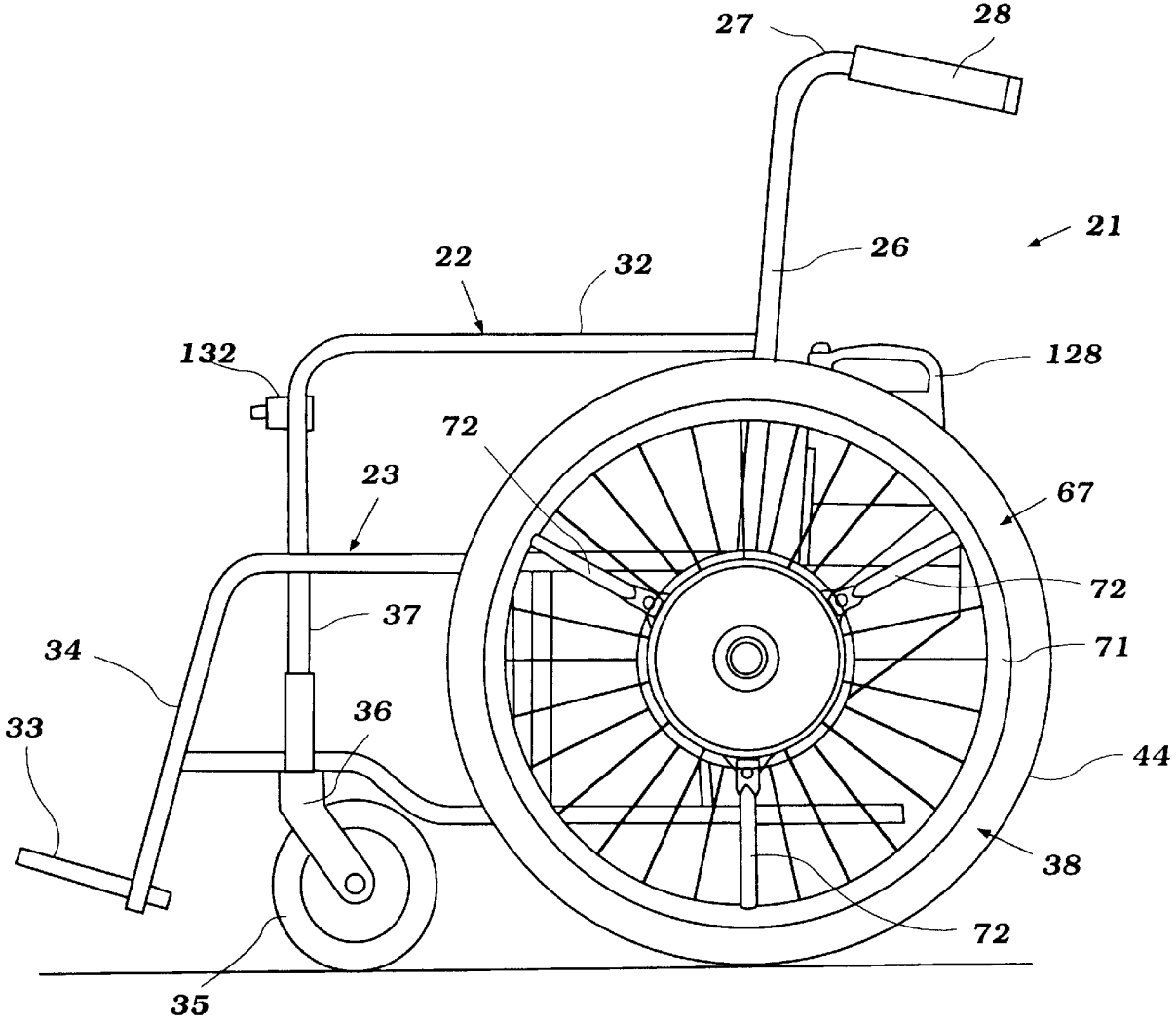
FIG. 1 is a side elevational view of a wheelchair constructed and operated in accordance with an embodiment of the invention.
Figure 2:
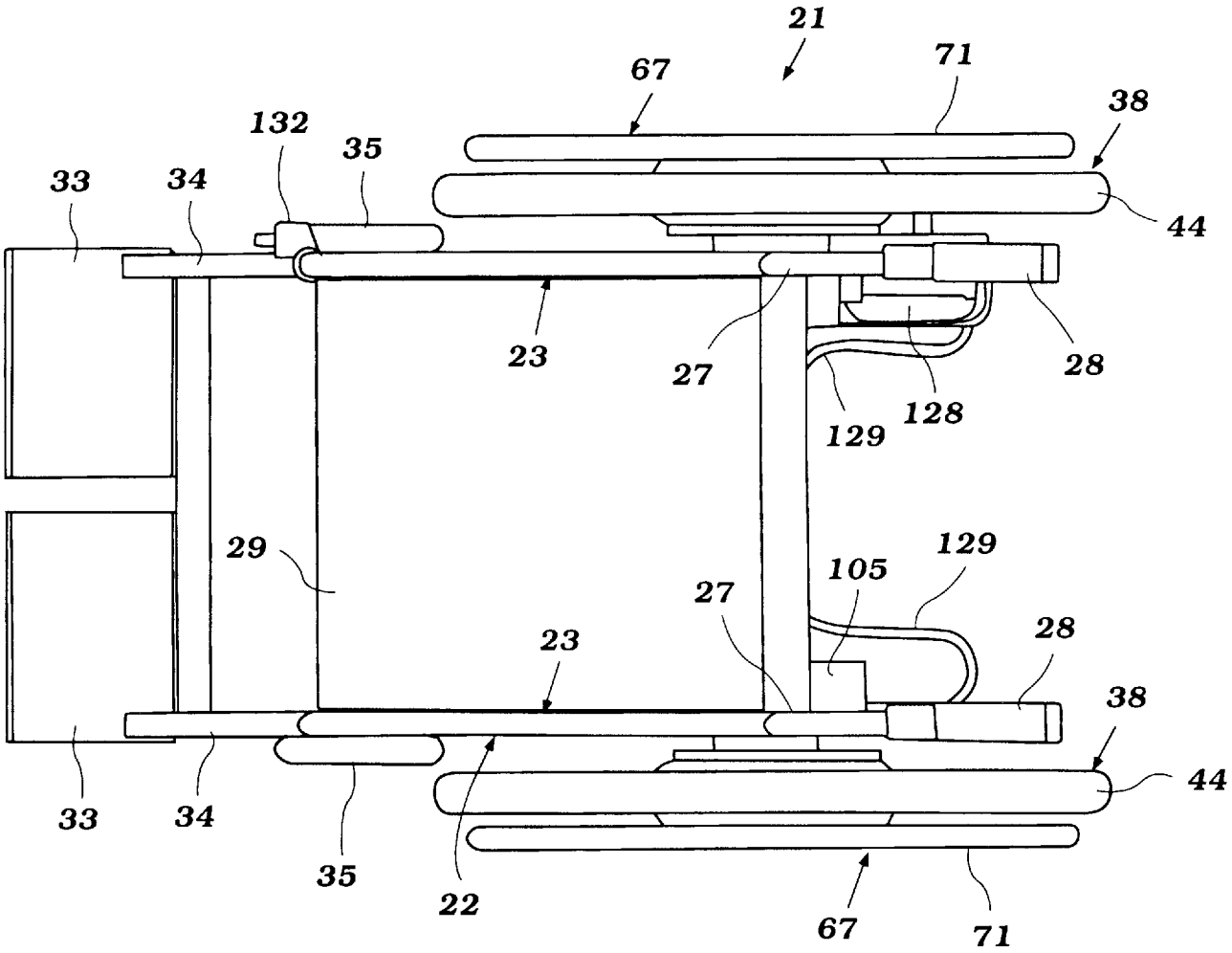
FIG. 2 is a top plan view of the wheelchair.
Figure 3:
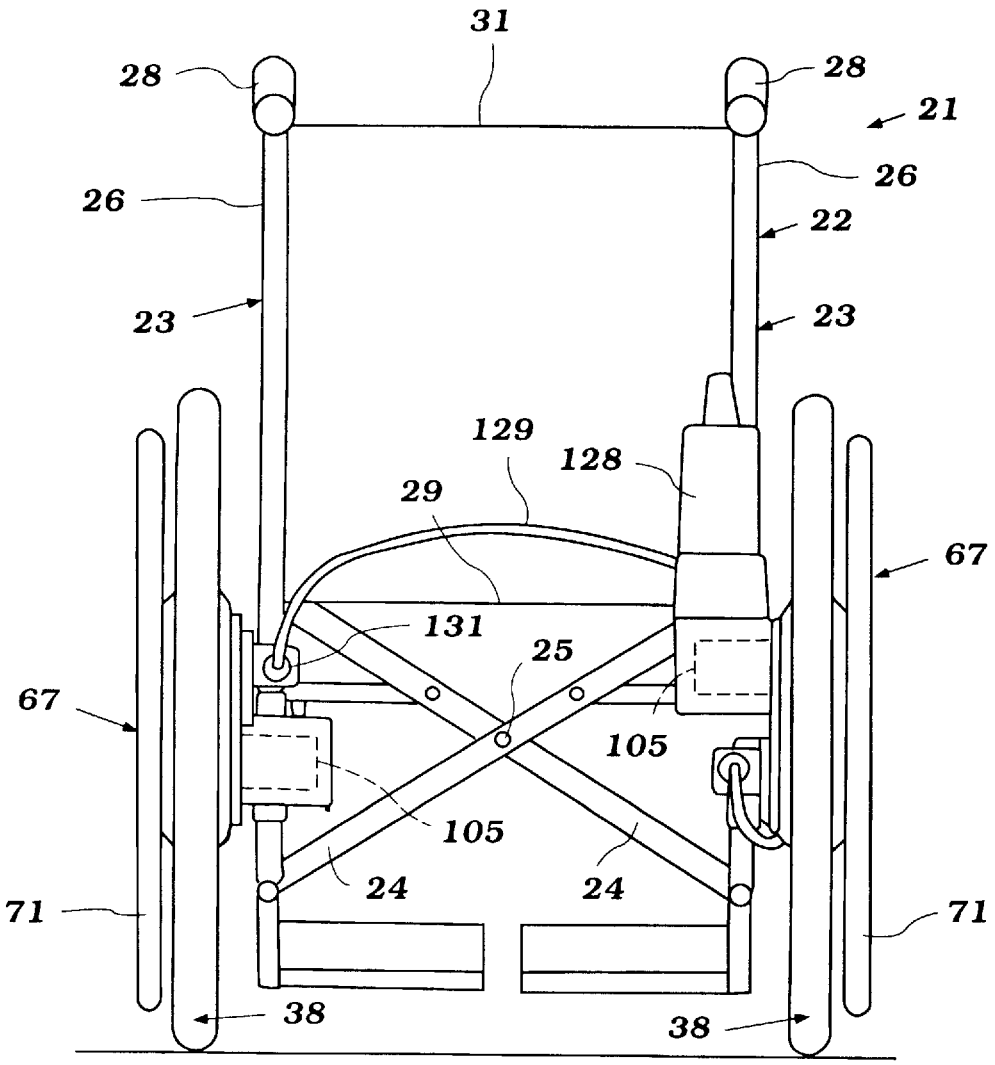
FIG. 3 is a rear elevational view of the wheelchair.

Referring now in detail to the drawings and initially to FIGS. 1–3, a foldable wheelchair constructed in accordance with an embodiment of the invention is identified generally by the reference numeral 21.

The foldable wheelchair 21 is comprised of a folding frame assembly, indicated generally by the reference numeral 22 which is comprised of a pair of tubular side frame members, each indicated by the reference numeral 23 and which have a generally h-shaped configuration in side elevation. These side frame members 23 are connected to each other by a scissors-type linkage system, comprised of a pair of links 24 pivotally connected to each other by a pivot pin 25. There is preferably a rear pair of links at the rear of the side frame members 23 and a front pair of links at the front of the side frame members 23.

The links 24 have pivotal connections at one of their ends to the side frame members 23 and sliding connections at their other ends to the side frame members 23 as is well known in this art. A suitable locking mechanism (not shown) may be provided for holding the side frame members 23 in their extended operative position as shown in the Figures and/or in their retracted storage or transportation position.

Upstanding legs 26 of the side frame members 23 are formed with integral push handles 27 which carry hand grips 28 at their upper ends so that an assistant or helper may push the wheelchair 21.

A canvas seat strap 29 and back strap 31 are connected at their ends to the side frame members 23 and handle portions 26, respectively, so as to accommodate a seated rider. These seat and back portions 29 and 31 are flexible so as to fold upon folding of the wheelchair 21.

Arm rests 32 are formed by horizontal parts of the side frame members 23 so as to support the seated occupant's arms. Foot rests 33 are connected to lower legs 34 of the side frame members 23 so as to accommodate the rider's feet. These foot rests also may be pivotal from their operative positions to storage positions, as is well known in this art.

A pair of front wheels 35 are connected by caster assemblies 36 to a further portion 37 of the side frame members 23 immediately to the rear of the foot rests 33. In addition, large rear wheels 38 are journaled by the side frame members 23 via a detachable connection, in a manner to be described, at the rear of the frame assembly and generally in line with the tubular portions 26.

The construction of the wheelchair 21 as thus far described may be considered to be conventional and as such forms no part of the invention, other than representing the environment in which the invention may be practiced. Therefore, where any component of the wheelchair 21 is not described in detail, any conventional construction may be utilized. Also, from the following description, those skilled in the art will readily understand how the invention may be applied not only to a wide variety of types of wheelchairs, but also that certain aspects may be applied to other types of manually-powered vehicles, both land and water.

The detachable support and journal for the rear wheels 38 and the drive therefor will now be described by primary reference to FIGS. 4–8 with the initial description being directed primarily to FIGS. 5 and 6. Each wheel assembly 38 and the drive therefor has substantially the same configuration except for its orientation as mounted to the frame 22. For that reason, only one wheel will be described.

Each wheel 38 includes a hub portion 39 which is mounted on the frame assembly 22 by a detachable connection that will be described later. This hub portion 39 has an integral outer area 41 to which one end of spokes 42 are laced in any suitable manner. These spokes 42 extend radially outwardly and are connected also by a lacing arrangement to an outer rim 43 that carries a tire 44.

A backing plate assembly, indicated generally by the reference numeral 45, has a central part that receives a support shaft 46 which support pin extends into the inner part of the wheel hub 39. Anti-friction bearings 47 rotatably journal the hub 39 on this shaft 46. A sleeve 48 is disposed between the bearings 47 to hold their spaced relationship.

A nut 49 is threaded onto the outer end of the shaft 46 so as to hold the assembly together in an axial direction. The nut 49 in effect holds the backing plate 45 against a shoulder 51 formed on the shaft 46.

On the other side of the shoulder 51, the shaft 46 detacheably extends into a bushing 52 that is affixed to the frame assembly 22 by a welded boss 53 that receives the sleeve 52 and, accordingly, the shaft 46. The sleeve 52 is held in place axially in the boss 53 by a nut 54.

A detent locking mechanism, indicated generally by the reference numeral 55 is provided for detachably affixing the shaft 46 and, accordingly, the backing plate 45 and wheel 38 to the frame assembly 22. This detent locking mechanism includes a plurality of detent balls 56 that are received in radially extending bores 57 formed in the shaft 46. The shaft 46 is hollow and an actuating pin 58 extends axially through it and has a headed end 59 on the outer side of the wheel 38. This headed end 59 is supported for reciprocation in a counter bore formed in the outer end of the shaft 46. A biasing coil spring 61 is received in this counter bore and urges the actuating pin 58 toward the right as shown in FIG. 5.

In this position, an enlargement 62 formed on the opposite end of the pin 58 will engage the balls 56 and urge them outwardly in their recesses 57 to engage the sleeve 52 and, accordingly, lock the wheel 38 and backing plate 45 axially in position. A snap ring 63 is provided on the headed portion 62 so as to limit the movement of the actuating pin 58 to the right under the action of the spring 61.

When the headed portion 59 is urged to the left against the action of the spring 61 in a manner which will be described shortly, the headed portion 62 will move clear of the balls 56 and they can then recede into their recesses 57 so that the wheel 38 and backing plate 45 may be pulled free in one motion, utilizing a minimum effort and no tools.

In order to hold the backing plate 45 against rotation, a frame tube 64 to which the mounting boss 53 is provided with a locking lug 65 that is engaged in a recess 66 in the backing plate so as to hold it against rotation.

A hand rim 67 is carried on the outer side of the wheel 38 in a manner which will be described. This hand rim 67 includes a cover piece 68 that has a central opening that is aligned with the pin head 59 and into which it extends. An elastic cap 69 closes this opening. By depressing the elastic cap 69, the pin head 59 may be moved to its released position in the manner which has already been described for removal of the wheel 38 and backing plate 45.

The way in which the hand rim 67 is connected for rotation with the respective wheel 38 will now be described by reference primarily to FIGS. 4 and 5. The hand wheel 67 has a circular rim portion 71 that is provided with three radially inwardly extending spokes 72 which are formed from a tubular sheet metal construction. The inner ends of these spokes 72 are flattened so as to be affixed by threaded fasteners 73 to lugs 74 of a hub member 75. The hub member 75 is connected to the wheel hub 39 and specifically an annular portion of it 76 by means of a lost motion biasing connection.

This lost motion biasing connection is actually comprised of three assemblies that are spaced around the hub 75 and 76 and in spaced relationship between the spokes 72 that connect the hand rim 71 to its hub 75.

An elastic seal 77 is provided between the hand wheel hub 75 and the outer hub portion 41 of the wheel assembly 38. This provides axial location of the hand rim assembly 67 relative to the main wheel 38 and will provide some vibration damping in addition to sealing the internal area from foreign elements. The cover 69 is affixed to the hand wheel rim 75 by threaded fasteners 77.

Figure 4:
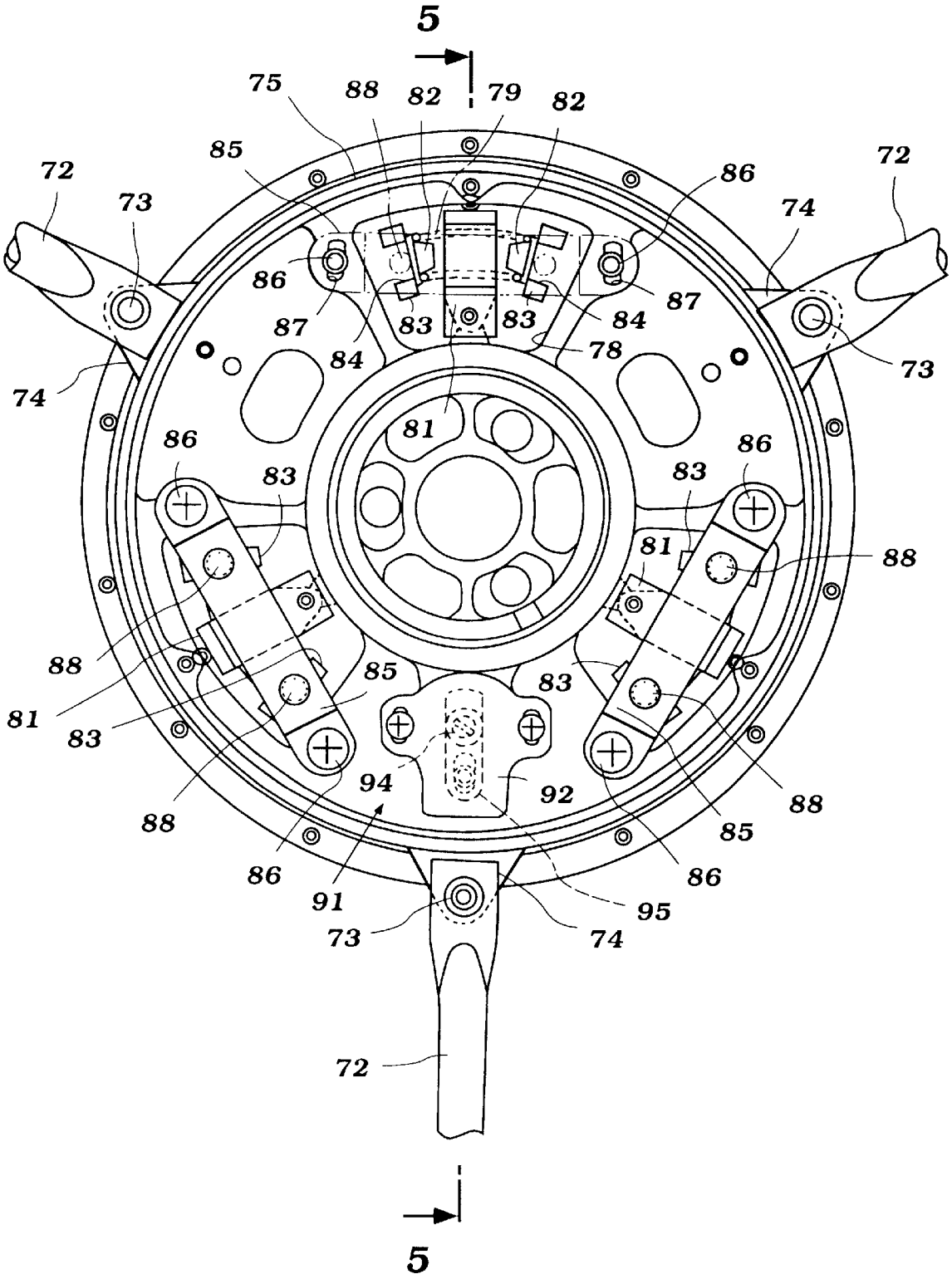
FIG. 4 is a side elevational view of one of the wheels and particularly the torque-sensing arrangement with the cover removed and showing only the hub portion.
Figure 5:
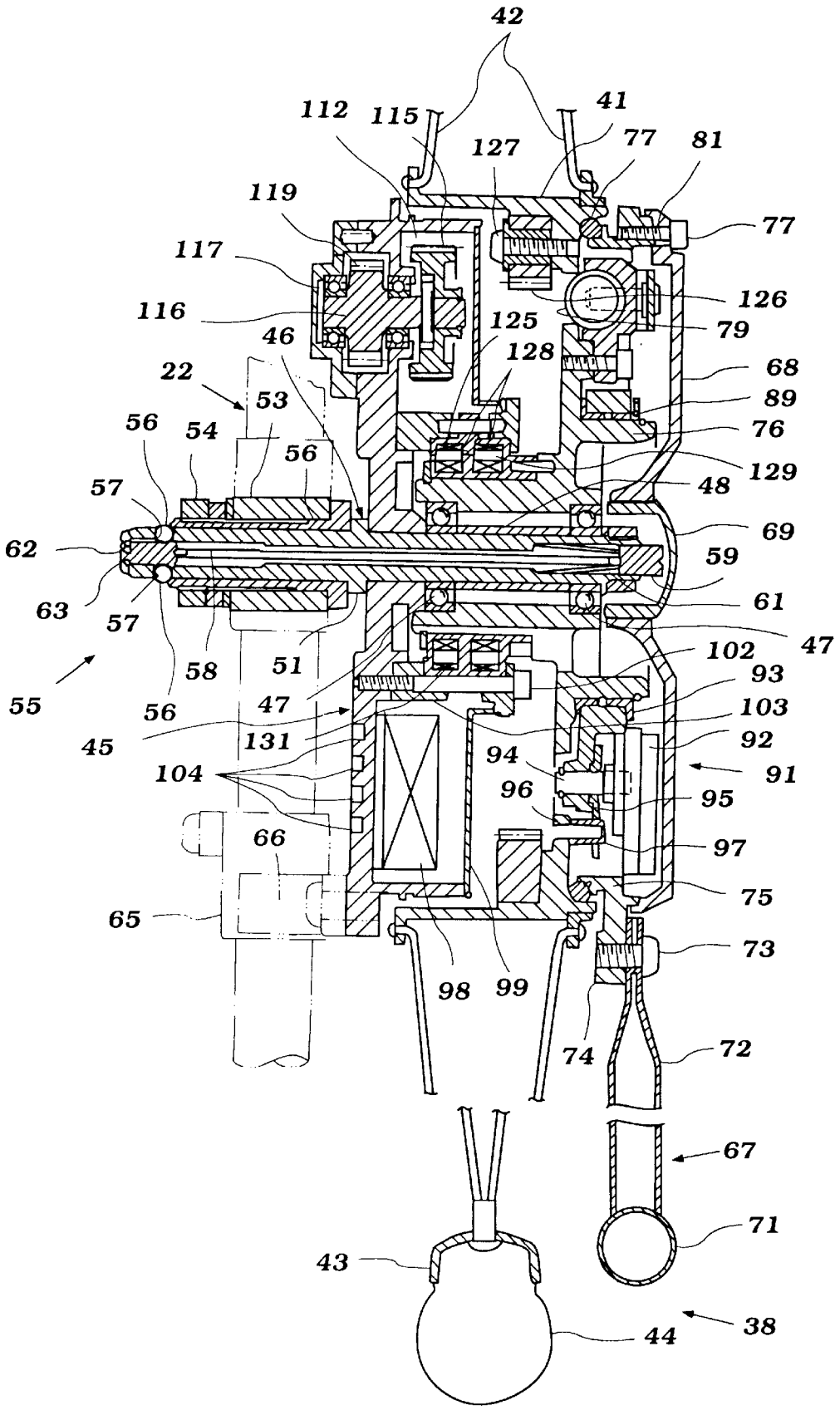
FIG. 5 is a cross-sectional view of the entire wheel and is taken along the line 5—5 of FIG. 4.

The lost motion connections which are utilized to sense the force applied by the rider to the hand rim 67 is shown best also in FIGS. 4 and 5. It should be noted that the wheel hub 39 is provided with three circumferentially spaced windows 78. In each of these windows, a coil compression spring 79 is positioned. The spring 79 is held axially relative to the wheel assembly 38 by means of spring retainers 81 which extend radially across and span these windows.

The ends of the springs 79 are received in spring receivers 82. The spring receivers 82 are urged by the springs 79 against shoulder lugs 83 that are formed on the wheel hub 39 and which extend into the rim openings 78. These lugs 83 have central apertures 84.

Retainer clips 85 are affixed to the hand wheel hub 75 by means of an adjustable connection that is comprised of threaded fasteners 86 that are fastened to the hub member 75 and slots 87 formed in these straps 85. The straps 85 carry pairs of pins 88 which in the neutral position extend into the lug slots 84. By adjusting the location of the brackets 85 in a radial direction, it will be possible to adjust the preload on the springs 79 and the points of contact of the pins 88 with the spring holders 82 in the desired position.

When the rider applies pressure to the hand rim 71, it will tend to rotate about a bearing surface provided by a bearing 89 relative to the wheel hub 39. Rotation in one direction or the other will cause A respective one of the pins 88 to urge the adjacent stopper 82 so as to compress the spring against the lug 83 of the wheel rim 39 at the other end. The wheel 38 will not initially rotated due to inertia and the degree of compression of the spring 79 before rotation begins will be an indication of the manual force applied by the rider to the rim 71.

In order to provide a usable source of information as to the torque or force which the operator has placed on each of the hand rims 71, a potentiometer assembly, indicated generally by the reference numeral 91 is provided. This potentiometer unit 91 outputs a signal that is indicative of the degree of rotation of the hand wheel 67 relative to the main wheel 38. This is in effect, equal to the degree of compression of the springs 79. This potentiometer construction is also shown best in FIGS. 4 and 5 and will be described by reference to those figures.

The potentiometer 91 is comprised of a potentiometer element 92 that contains a typical type of potentiometer mechanism such as a wound resistor and wiper arm. The housing 92 is mounted in the wheel hub 39 by a mounting assembly 93 that permits adjustment of the rotary position of the potentiometer 92 for null setting. A shaft 94 of the potentiometer element extends outwardly of the housing and carries a lever arm 95. The lever arm 95, in turn, is engaged with a pin 96 affixed to the wheel rim 36 and which is surrounded by an elastic sleeve 97. The elastic sleeve 97 ensures that the connection between the pin 96 and lever 95 will not become loose and will not wear.

As will become apparent by description to the figures of the electrical circuitry, the potentiometer output is transmitted to a controller, indicated generally by the reference numeral 98 and which is axially displaced from the potentiometer assembly 91. The controller 98 is provided in a cavity formed in the backing plate 45 and which is closed by a cover plate 99 so as to effect sealing therebetween. The cover plate 99 is held in place by a retaining plate 101 and threaded fasteners 102.

The threaded fasteners 102 are threaded into bosses 103 formed on the backing plate. In order to maintain low temperature for the controller 98, the backing plate is provided with a plurality of grooves 104 which in effect form heat radiating ribs therebetween so as to assist in the dissipation of heat.

The output from the controller 98 is transmitted to an electric motor that provides an electric power assist for the transmission, this motor being indicated by the reference numeral 105. The motor 105 drives the wheel 38 through a transmission which will be described by particular reference to FIGS. 5–8.

Figure 6:
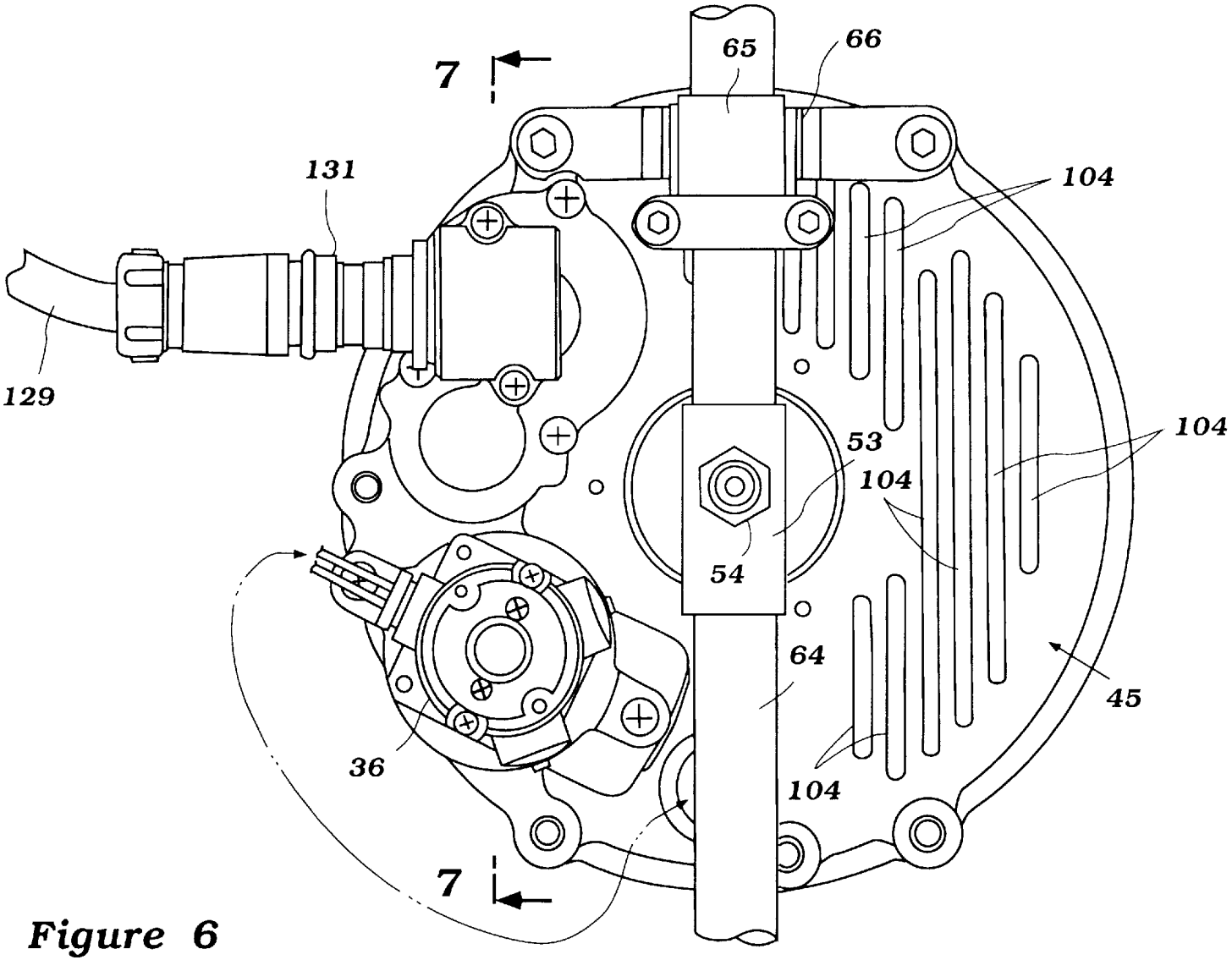
FIG. 6 is a rear elevational view of the wheel backing plate portion and shows its attachment to the frame.
Figure 7:
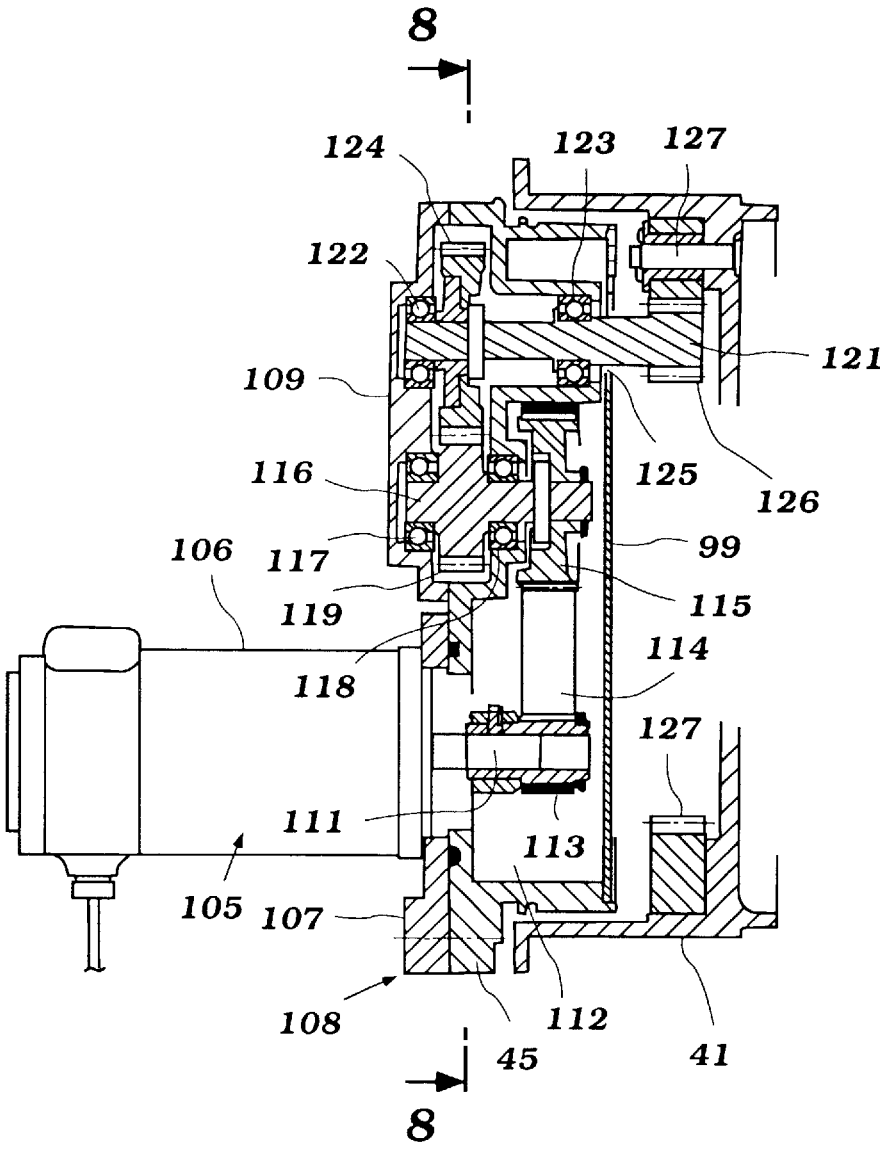
FIG. 7 is a cross-sectional view taken along the line 7—7 of FIG. 6 and shows the driving motor and its relationship to the transmission.
Figure 8:
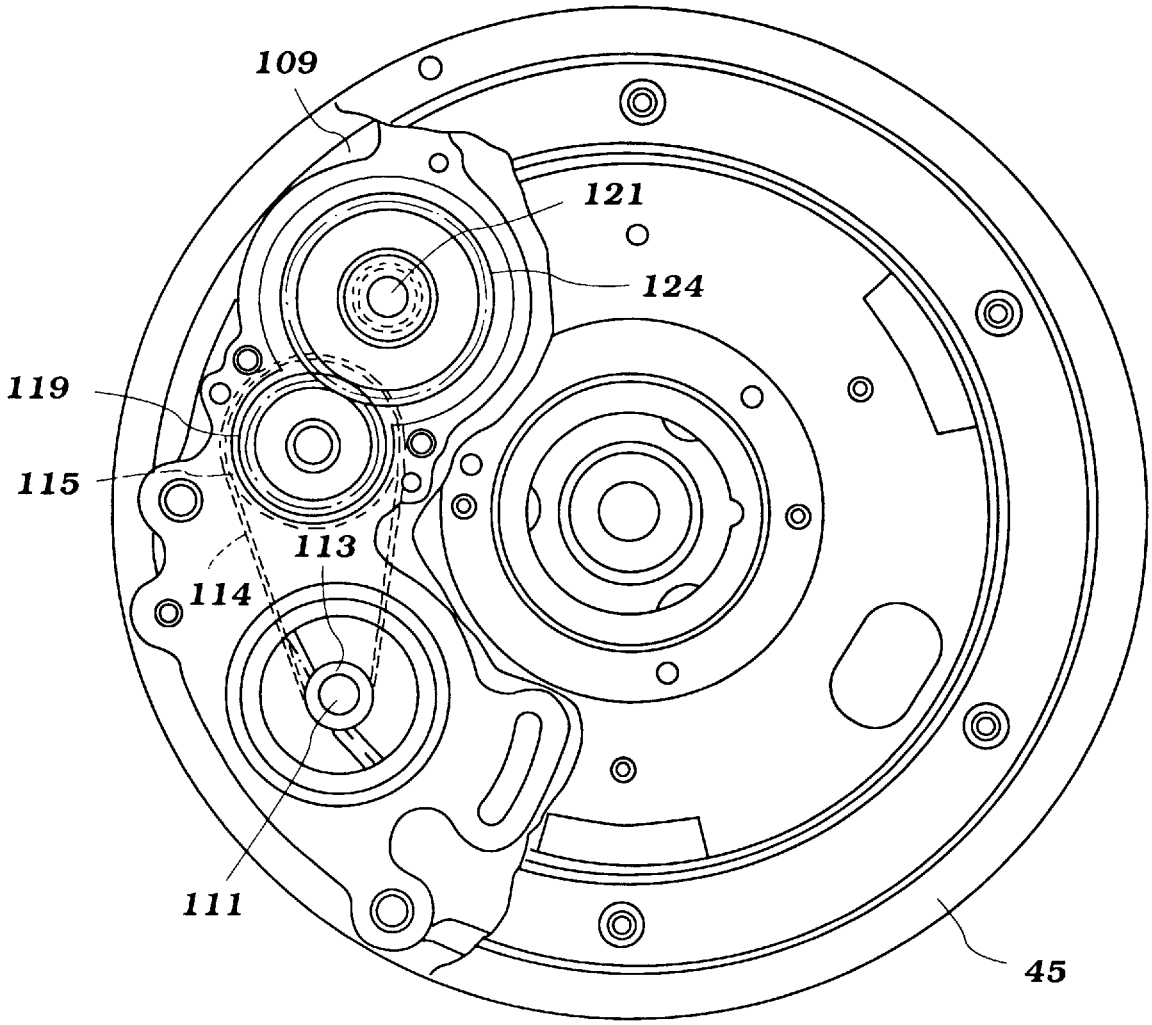
FIG. 8 is a view looking generally in the direction of the line 8—8 of FIG. 7 and shows a further portion of the transmission.

The electric motor 36 is shown out of place in FIG. 6 in order to more clearly show the construction and its mounting on the backing plate 45. The motor 105 is basically a DC motor of any known type which is reversible and which has an outer housing 106. This outer housing 106 is mounted to a plate 107 which forms a part of a combined motor mounting and transmission case assembly 108. This assembly 108 includes the backing plate 45 and an outer cover plate 109 all of which lie on the outer periphery of the backing plate 45. An inner housing cover 109 at least partially encloses the transmission assembly.

The motor 105 has a motor output shaft 111 which extends into the transmission cavity 112 formed by the assemblage including the cover plate 109. There, a pulley 113 is affixed to the motor output shaft 111 and drives a drive belt 114. The drive belt 114, in turn, drives a driven pulley 115 which is keyed for rotation to a shaft 116 that is journaled in bearings 117 and 118 carried by the cover plate 109 and backing plate 105, respectively.

A gear 119 is formed integrally with the shaft 116 and drives a second transmission shaft 121. The transmission shaft 121 is journaled by bearings 122 and 123 carried by the plates 109 and 110, respectively. A gear 124 is affixed for rotation with the shaft 121 and is engaged with the gear 119 so as to drive the shaft 121.

The shaft 121 and specifically the portion of it that extends through an opening 125 in the cover plate 99 is formed with an integral gear 126. This gear 126 meshes with a ring gear 127 that is affixed for rotation with the wheel rim 41 so as to establish a driving relationship therebetween. This ring gear 127 is fixed to the rim by fasteners 127.

The transmission as thus far described provides a substantial step down in speed from the speed of the motor output shaft 111 to the speed of rotation of the wheel 38 so as to provide a force application in addition to the speed reduction.

As seen in FIG. 3 the motor 105 associated with one of the wheel assemblies 38 is staggered relative to that of the other wheel assembly 38. This permits the motors 105 to nest with each other when the wheelchair 21 is folded. Thus even if the wheel chair 21 is folded with the wheels in place, a compact folded assembly results.

It has been noted that the output signal from the potentiometer 91 is transmitted to the controller 98. Since the potentiometer 91 is mounted for rotation with the hand wheel 67 and, accordingly, with the main wheels 38 and the controller 98 is fixed, a rotary-type connection, indicated by the reference numeral 128 is provided for transmitting the signals via this path. This connection 128 includes outer members 129 that are fixed to the backing plate 45 and cooperating inner wipers 131 that are fixed for rotation with the wheel hub 39. As a result, the transmission of electrical signals is possible.

Figure 9:
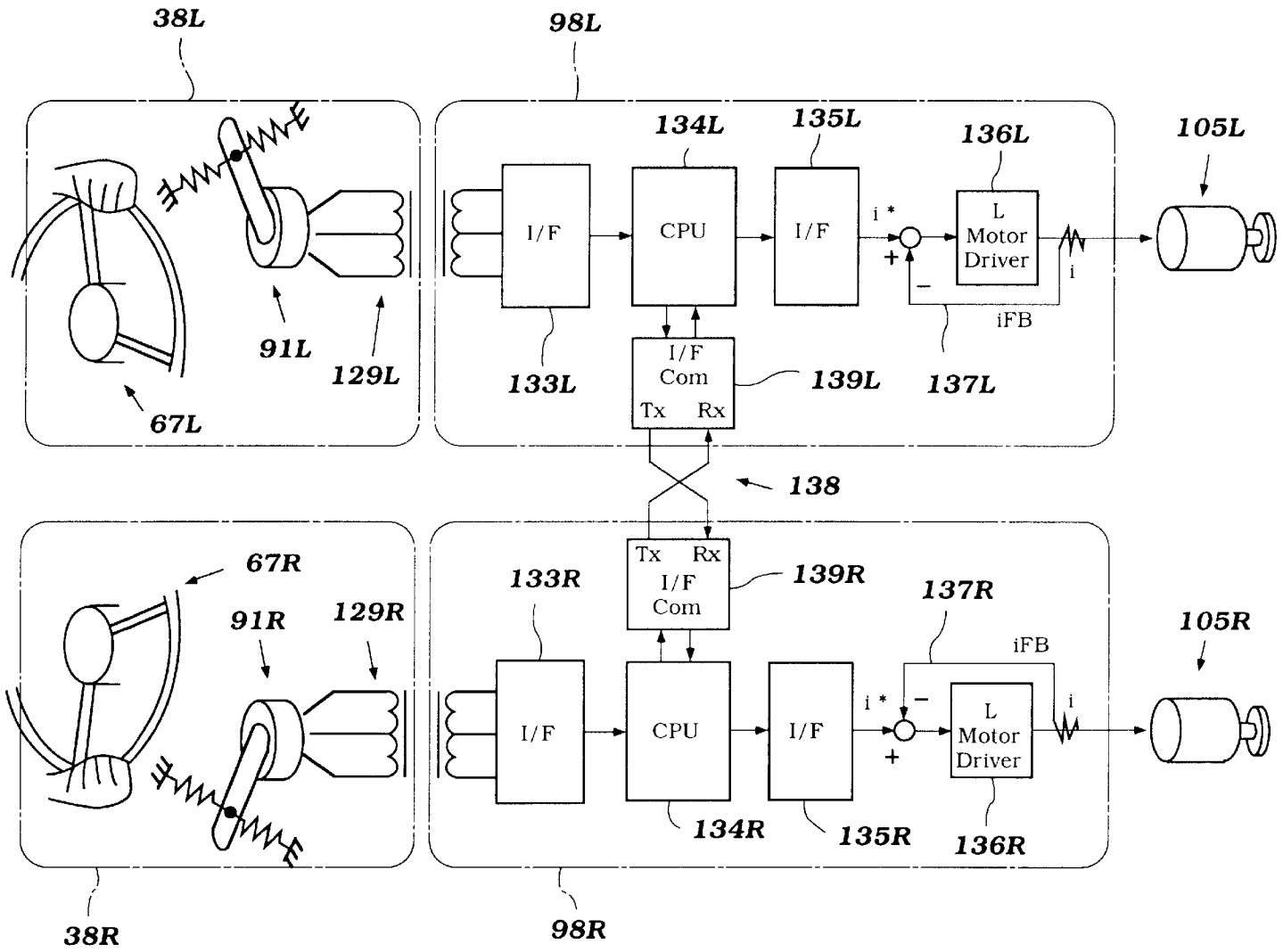
FIG. 9 is a partially schematic view illustrating the relationship between the hand rim, torque sensors and assist motors associated with each wheel.

Having thus described the physical hardware associated with the invention, the methodology by which the device operates and the control arrangement therefore will now be described by reference to FIGS. 9–15. FIG. 9 shows schematically the interconnection between the mechanical and electrical components and the control and a portion of this same relationship is illustrated in FIG. 12. In FIGS. 9 and 12, the components associated with the left-hand wheel 38 have been identified with the suffix L while those with the right-hand side have been identified with the suffix R. This same designation is utilized in conjunction with the other descriptions so as to facilitate understanding of the invention.

It will be seen that the wheel side, indicated at 38L and 38R, respectively, comprise the hand rims 67L and 67R which in turn, operate the potentiometers 91L and 91R in the manner which has already been described so as to provide the torque output signal. These signals are transmitted as noted, through the rotary connection 129L and 129R to the respective controllers 98L and 98R. These controllers control the transmission of electrical power from a battery, indicated generally by the reference numeral 128 (FIGS. 1–3) to the electric motors 105L and 105R, respectively.

Electrical cables 129 transmit these signals through connectors 131. It should also be noted that a main switch 132 is mounted on one of the side frames 23 in easy reach of the operator or rider so that he can disable the electrical system if desired.

Referring now again back to FIGS. 9–15 and specifically to FIGS. 9 and 12, the respective torque sensor signals are transmitted to electrical interfaces 133 that convert the analogue signals to digital signals and transmit them to the respective CPUs 134L and 134R. These signals then determine a target torque value for assist from the electric motor depending upon the sensed input torque, in a manner which will be described.

This signal is then transmitted from the CPUs 134 to respective motor control input/output interfaces 135L and 135R which, in turn, drive the motor driver circuits 136L and 136R which output the control signals to the motors 105L and 105R for providing the power assist.

Feedback circuits 137L and 137R provide feedback signals of the current flow so that the controller will provide a feedback control so as to match the power assist with the target torque so as to obtain the desired amount of power assist.

The portion of the control circuit as thus far described may in fact be substantially the same as the prior art type of arrangements employed for these types of applications. However, in accordance with the invention, the controls of the individual wheels 38 and their assist motors 105L and 105R are not independent of each other. Rather, the CPUs 134L and 134R communicate with each other through a communication system, indicated generally by the reference numeral 138.

This communication system 138 is comprised of a pair of communication interfaces 139L and 139R which communicate with each other through cross circuits through serial cables so as to transmit and receive signals between the CPUs 134L and 134R. These transmission and reception signals are indicated by the legends TX and RX.

This communication system and its effect on the assist control will be described later by more reference to FIGS. 12–15. The basic control system and methodology will, however, be described by reference to FIGS. 10 and 11 which show the torque relationships in the system.

Figure 10:
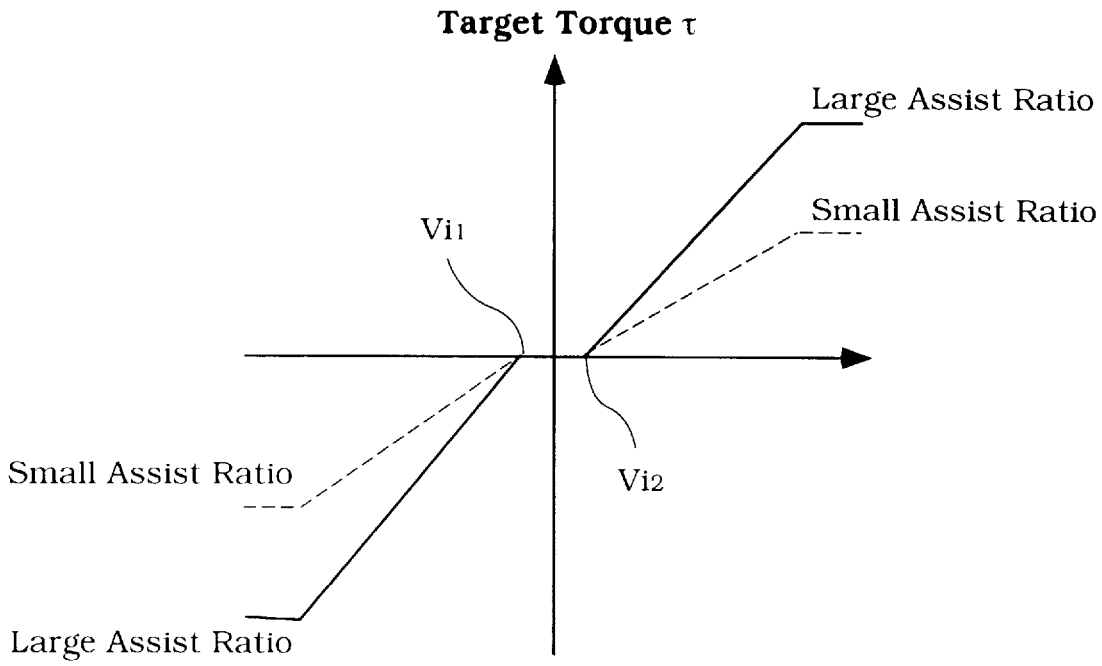
FIG. 10 is a graphical view showing the relationship between human power input and target torque in relation to assist ratio.

As has been noted, the CPUs 134 determine from the input force an output or target force or torque, indicated by the value $\tau$ at an appropriate assist ratio. FIG. 10 illustrates a typical arrangement that shows how the target torque $\tau$ is related to the input signal Vin of manual input force. The target torque will be either positive or negative depending upon whether the rider turns the respective hand wheel 67 in a forward or reverse direction. There is a range on either side of the zero input amount indicated at $V_{i1}$ and $V_{i2}$ wherein there is no selected output torque, ie. $\tau=0$. This is a null range so as to accommodate electrical noise and to avoid inadvertent application of electric power assist. Two curves are shown having different assist ratios. As may be seen, at the extreme end of each curve when there is a high manual input, the assist ratio is held constant even though the input force may be increased. This is to avoid over speed conditions.

Figure 11:
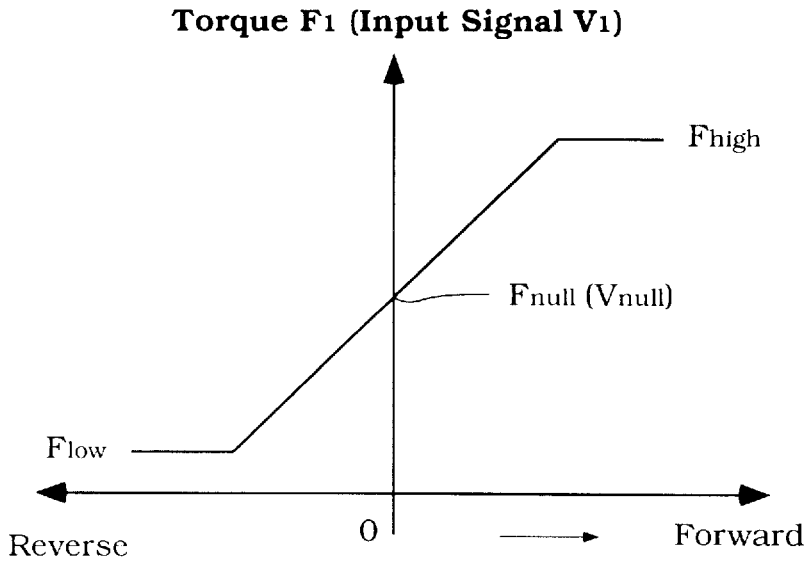
FIG. 11 is a graphical view showing human power and output torque signals in the forward and reverse modes.
Figure 12:
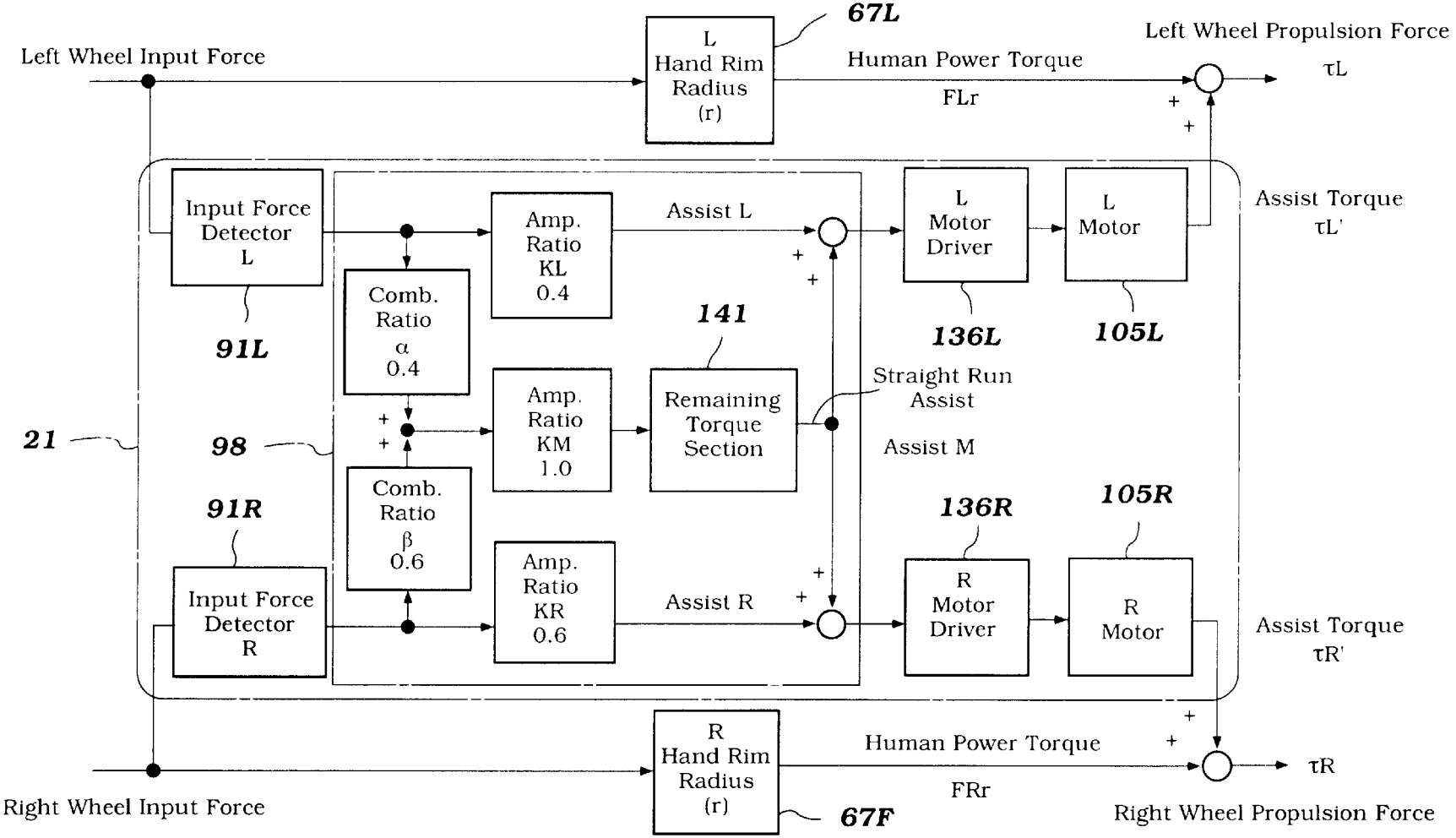

FIG. 11 shows the relationship of the actual input torque in both the forward and reverse directions from the null point and shows the same characteristics as FIG. 10 except for the fact that the null point is compressed because we are dealing here with the output signal rather than the actual input force.

Again, this portion of the description is typical for both conventional power-assisted wheelchairs and those constructed in accordance with the invention. In accordance with the invention and as has already been noted, the actual power assist provided by the respective motors 105L and 105R is not determined solely from the input of the respective sensor 91L and 91R but rather a factorial combination of the two input signals. This will now be described by particular reference to FIG. 12 which shows the electrical inner relationship between the control components and FIGS. 13–15 which describe the actual control routine.

Referring first to FIG. 12, this is a schematic illustration showing the wheelchair and the hand rims 67 in combination with the various controller. Also illustrated in this figure is the indication of the actual torque applied to each wheel indicated at τL and τR. Basically, the system operates so that the actual torque τL and τR apply to each wheel when in a straight-ahead mode is equal so that the wheelchair 21 will not tend to deviate from a straight path. The total torque applied to each wheel 38 is the sum of the manual input force FL multiplied by the hand rim radius R which results in the human power input torque FLr or FRr. In addition, there is provided an assist torque τL' and τR' which is added to the manual force so as to give the resulting torque τL and τR.

When the rider is turning to the left or right, the torque τL and τR will not be equal but the appropriate assist will be exerted on the wheel that is determining the direction of turning.

In addition to these assists, when the manual or human force is discontinued, a resulting torque M is applied to each wheel through its respective assist motor 105L or 105R. This system is designed so that this assist force will be equal and will decay gradually. By applying an equal continuing force, the wheelchair 21 will tend to travel in a straight line. This is true whether it has been traveling straight prior to the discontinuance of the manual force or was turning. In other words, if the operator effects a turn and then discontinues applying any force, rather than continuing to turn the wheelchair will travel in the final direction which the operator had commanded manually.

Referring now specifically to FIG. 12, it will be seen that the input force detectors 91 sense the respective manual input forces applied to each wheel. These force signals are transmitted, as aforenoted, to the CPU 98 and specifically to the first stage thereof associated with each wheel. In the first stage, there is maintained a combination ratio, indicated at α and β and a force amplification ratio, indicated at KL and Kr, for the left and right wheels, respectively. These values are preset based on the relative strengths of the operators arms. There is also maintained an amplification ratio KM.

This signal is transmitted so as to calculate products of the input force signals FL and FR and the amplification ratios KL and KR, respectively. These then result in a left-hand and right-hand assist force, assist L and assist R. In the illustrated example it is assumed that the rider is stronger in his left arm than in his right arm. Thus the amplification ratio KL and combination ratio α for the left side are set lower than the amplification ratio KR and combination ratio β for the right side. Thus when the operator wishes to travel in a straight line he may do so easily. In the specific examples these values are 0.4 and 0.6. Of course the ratios can be varied to suit individual riders.

In addition, the product of the signal FL and the combination ratio α and the product of the signal FR and the combination ratio β are calculated. Then a product of the sum of them and the amplification ratio FM is calculated. Using the calculated results, the remaining torque section 141 outputs an assist torque, assist M, which is added to the left-hand and right-hand assist (Assist L and Assist R) when the manual force is being applied and which, when the manual force input is stopped, gradually decays so as to provide a straight run assist.

The summed signals are then outputted to the left-hand and right-hand motor driver circuits 136L and 136R which in turn energize the left-hand and right-hand assist motors 105L and 105R with the respective assist torque τL' and τR'. Thus, the resulting torques τL' and τR' are applied to the wheels 38 so as to effect their drive.

Figure 13:
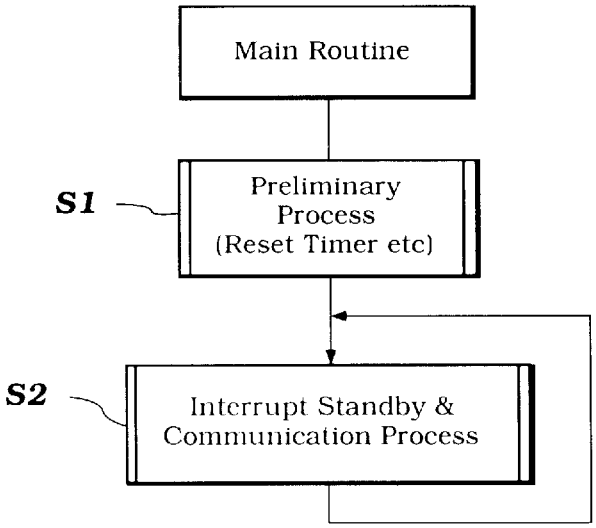
FIG. 13 is a block diagram showing a portion of the power-assist control routine.

The control routine by which this system operates will now be described by reference to FIGS. 13–15. Starting in FIG. 13, the main control routine is shown and includes a preliminary processing step S1 at which the various memories and timers of the CPUs 98 are reset. The program then moves to the main routine S2 that is comprised of an interrupt standby and communication process wherein information is exchanged and this program then continues to repeat through this step.

Figure 14:
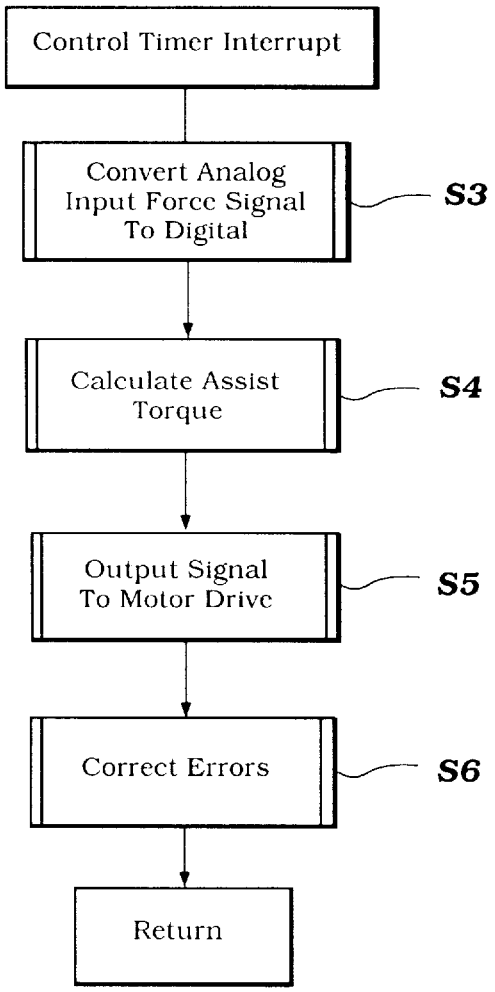
FIG. 14 is a block diagram showing a further portion of the power-assist control routine.
Figure 15:
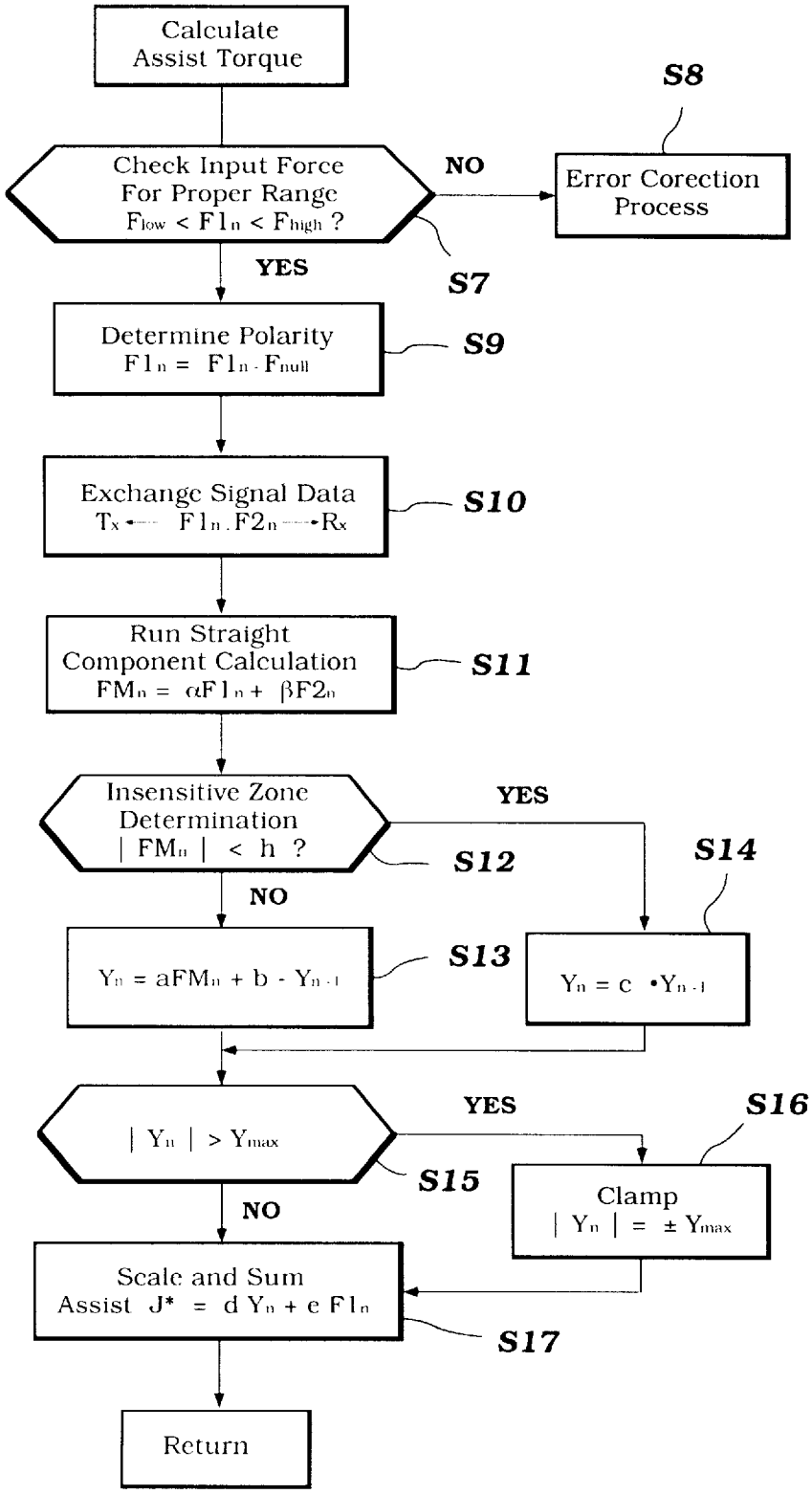
FIG. 15 is a block diagram showing yet another portion of the power-assist control routine.

The steps of the interrupt and communication process are described in FIG. 14. As seen in this figure, the program begins at a step S3 wherein the analog data from the force detectors 91 is received and processed. This digital signal is then transferred at the step S4 so as to calculate the target torque using the values KR, KL, α, β, and KM for the respective wheel.

The program then moves to the step S5 wherein the calculated value is outputted to the respective motor driver 136L or 136R. The program then moves to a step S6 so as to process any error information detected in the previous steps and to correct it. The program then repeats as previously noted.

The actual torque assist process carried out at the step S4 is shown in more detail in FIG. 15 and will now be described by reference to that figure. This program begins at the step S7 and compares the human power input force F1*n* with a range of acceptable high and low limit values Flow and Fhigh. The symbol n indicates the number of readings or times in the calculation this is that the first reading or time n=1, second reading or time n=2, etc.

If at the step S7 it is determined that the input torque is outside the acceptable range, the program moves to the step S8 so as to perform the error correction routine shown at the step S6.

If, however, the sensed instantaneous input force F1*n* is within the appropriate range, the program then moves to the step S9 so as to determine the polarity of the force. That is, the force is determined to be either positive (forward) or negative (reverse). This is done by subtracting from the input force figure F1*n* a null value Fnull. If the result of this calculation is positive, it is determined that the direction is forward. If it is determined that the value is less than 0, then it is determined that the operator is calling for reverse rotation of the respective wheel. These values are represented by the curve of FIG. 11, as previously noted.

The program then moves to the step S10 so as to exchange data with a register. That is, the force F1*n* applied to the one wheel is sent to a register TX and the force from the other wheel F2*n* is sent to a register RX. These registers store the received data.

The program then moves to the step S11 so as to calculate the amplification ratio or remaining torque value for the run straight assist. This is done by computing the value $FMn=\alpha F1n+\beta F2n$. As has been noted, this is the value that is employed to maintain straight running when the operator calls for straight running and also to gradually decay the coating speed downwardly while still running straight after the operator discontinues applying the manual force and regardless of whether his previous action has been to turn the wheelchair 21 or has been merely driving it in a straight direction.

Having calculated the run straight component FMn at the step S11, the program then moves to the step S12 to determine if this value is less than a predetermined value h. This is to determine if the system is operating in what is considered an insensitive zone where the assist value is smaller than this amount. If the determination is that the value FMn is less than the value h then the program moves to the step S13 to perform an integration calculation. This integration calculation determines the value Yn by multiplying the computer value FMn by a constant "a" and adding to that the previous value of Y calculated YM−1 by another constant "b".

If, however, at the step S12 it has been determined that the system is operating in the insensitive zone, that is that the rider is decreasing the force exerted on the wheels because the value FMn is less than h the program moves to the step S14 to attenuate the previous value of Y by multiplying the previous value Yn−1 by a constant "c" to develop a new decreased value of Y. This is to cause the gradual slowing when operator force is not being increased.

Having thus calculated a new value for Yn at either the steps S13 or S14, the program moves to the step S15 to determine if the new value for Y is greater than a predetermined maximum value Ymax. This is to ensure that there will not be too great an assistance by the electric motors 105 which would cause the speed of the wheelchair to become too high. If the value of Yn is determined to exceed the value Ymax at the step S15, the program moves to the step S16 to in effect put a clamp on and limit the assist torque to the Ymax assist value.

When the value Yn has been determined less than the value Ymax at the step S15, or if it has been greater at that step and the new value for Yn is set at Ymax at the step S16, the program then moves to the step S17 to determine the final resulting output torque that will be exerted on the respective wheel for the assist. In other words, the value for the respective assist torque is determined by taking the value Yn, multiplying it by a constant "d", and adding the manual input value F1*n* times another constant "e". The constants d and e are specific coefficients depending upon the amplification ratio KM and the coefficient ratio KL or KR, depending upon the wheel in question. The program then returns.

Thus, from the foregoing description it should be readily apparent that the described control accomplishes a number of functions. First, it will be ensured that the wheelchair travels in a straight direction when this is the operator's demand even if one arm is stronger than the other. Also, by traveling in the straight direction the rider finds it easier to turn when he desires. In addition, by decaying the speed slowly when the rider ceases to apply manual power then the rider has a natural coasting feeling and feels comfortable.

Also, since the decaying power is uniform on each wheel, the wheelchair will continue to move in a straight direction. Even though the rider may apply a force to only one wheel, if the assist ratios and combination ratios are properly chosen a force will be applied to the other wheel which assist and reduces the rider's effort. The decaying assist power also ensures that if a rider is on a hill that the wheelchair will not suddenly roll down the hill.

Since the wheels and assist mechanisms are formed as a separate detachable unit, the manufacturing costs can be reduced and repairs and packing can be facilitated. Furthermore, since the two CPUs are interconnected by a serial cable, then different data can be sent at different time intervals and the number of single lines and cables reduced.

Although the arrangement has been described in conjunction wherein a target torque has been set the system can also operate in response to speed. Also, a target voltage may be applied.

Of course, the foregoing description is that of preferred embodiments of the invention, and various changes and modifications may be made without departing from the spirit and scope of the invention, as defined by the appended claims.

What is claimed is:

1. A power-assisted manually operated wheelchair having a seat for a rider, a pair of ground engaging wheels disposed on opposite sides of said seat, each of said wheels having a hand rim for operation by a rider seated in said seat to turn said wheels and manually propel said wheelchair, prime mover means associated with each of said wheels for selectively assisting manual force applied to said wheels, a pair of force sensors each associated with a respective of said hand rims for sensing the manual force applied thereto, and control means for controlling said prime mover means so that the power-assist provided to each wheel is related to the force sensed by both of said force sensors.

2. A power-assisted manually operated wheelchair as set forth in claim 1, wherein the prime mover means comprises a pair of electric motors, each associated with and driving a respective one of the wheels.

3. A power-assisted manually operated wheelchair as set forth in claim 2, wherein the force applied to each wheel by the respective electric motor may be expressed mathematically as T=f(FL,FR) where T is the assist power and FL and FR are respectively the sensed forces applied to the wheels.

4. A power-assisted manually operated wheelchair as set forth in claim 1, wherein the control means applies an assist force to each wheel which is based upon a force proportional to the sensed force manually applied to the hand rim and a further force calculated as a residual force FM which is equal to $\alpha FL+\beta FR$ where FL and FR are the manual forces sensed by the manual force sensors associated with the left and right rims respectively and $\alpha$ and $\beta$ are constants.

5. A power-assisted manually operated wheelchair as set forth in claim 4, wherein the prime mover means comprises a pair of electric motors, each associated with and driving a respective one of the wheels.

6. A power-assisted manually operated wheelchair as set forth in claim 1, wherein the control means continues to supply assist power to both of the wheels for a time period after manual force is application to both of the hand rims is discontinued.

7. A power-assisted manually operated wheelchair as set forth in claim 6, wherein the assist force applied to the wheels by the control means after manual force input has ceased gradually decays.

8. A power-assisted manually operated wheelchair as set forth in claim 6, wherein the continuing assist force provided by the control means to the wheels is equal so that the wheelchair runs in a straight direction.

9. A power-assisted manually operated wheelchair as set forth in claim 8, wherein the assist force applied to the wheels by the control means after manual force input has ceased gradually decays.

10. A power-assisted manually operated wheelchair as set forth in claim 9, wherein the prime mover means comprises a pair of electric motors, each associated with and driving a respective one of the wheels.

11. A power-assisted manually operated wheelchair as set forth in claim 1, wherein each wheel is comprised of a backing plate mounting a respective prime mover and a transmission for driving the wheel from said prime mover, a hand rim affixed to said wheel for relative movement thereto through a limited range, the force sensor senses the force by sensing the relative movement, and wherein the entire wheel, backing plate, hand rim and prime mover are detachable as a unit from a frame of the wheelchair.

12. A power-assisted manually operated wheelchair having a seat for a rider, a pair of ground engaging wheels disposed on opposite sides of said seat, each of said wheels having a hand rim for operation by a rider seated in said seat to turn said wheels and manually propel said wheelchair, prime mover means associated with each of said wheels for selectively assisting manual force applied to said wheels, a pair of force sensors each associated with a respective of said hand rims for sensing the manual force applied thereto, and control means for controlling said prime mover means so that the power-assist provided to each wheel is related to the force sensed by each of said force sensors, said control means continuing to supply assist power to both of said wheels for a time period only after manual force is application to both of the hand rims is discontinued.

* * * * *